US005224821A

United States Patent [19]

Ozawa

[11] Patent Number: 5,224,821

[45] Date of Patent: Jul. 6, 1993

[54] WATER PUMP

[75] Inventor: Yasuo Ozawa, Kariya, Japan

[73] Assignee: Aisin Seiki Kabushiki Kaisha, Kariya, Japan

[21] Appl. No.: 841,512

[22] Filed: Feb. 26, 1992

[30] Foreign Application Priority Data

Feb. 27, 1991 [JP] Japan ..... 3-009825

[51] Int. Cl.[5] ..... F01D 5/14

[52] U.S. Cl. ..... 415/169.1; 416/181; 416/223 R; 416/231 R

[58] Field of Search ..... 416/223 R, 223 B, 231 R, 416/231 B, 181; 415/169.1

[56] References Cited

U.S. PATENT DOCUMENTS

| | | | |
|---|---|---|---|
| 142,992 | 9/1873 | Cross | 415/903 |
| 2,008,308 | 7/1935 | Jacobsen | 415/56.1 |
| 2,248,174 | 7/1941 | Jacobsen | 415/56.1 |
| 3,213,794 | 10/1965 | Adams | 416/181 |
| 3,606,569 | 9/1971 | Wallace | 416/181 |
| 3,606,577 | 9/1971 | Conn | 416/181 |
| 4,538,959 | 9/1985 | Cantor et al. | 415/98 |
| 4,981,413 | 1/1991 | Elonen et al. | 415/169.1 |
| 5,167,678 | 12/1992 | Elonen et al. | 415/169.1 |

FOREIGN PATENT DOCUMENTS

| | | | |
|---|---|---|---|
| 2-76197 | 6/1990 | Japan . | |
| 2062118 | 5/1981 | United Kingdom | 416/179 |

*Primary Examiner*—John T. Kwon

*Attorney, Agent, or Firm*—Oblon, Spivak, McClelland, Maier & Neustadt

[57] ABSTRACT

A water pump is comprised of a housing having therein a pumping portion and a bearing portion, a shaft rotatbly supported by the bearing portion, an impeller fixedly mounted on one end of the shaft and having a frontward side and a rearward side, a plurality of equally pitched vanes in the circumferential direction, and a hole device penetrating the impeller with making an angle relative to the rotation direction thereof.

5 Claims, 3 Drawing Sheets

WATER PUMP

BACKGROUND OF THE INVENTION

FIELD OF THE INVENTION

The present invention relates to a water pump and in particular to a water pump which is used to circulate compulsory a water for cooling an engine.

DESCRIPTION OF THE RELATED ART

In Japanese Utility Model Laid-open Print No. 2-76197 published examination in the 2nd year of Heisei corresponded to 1990 A.D., an example of the related art to the present invention is disclosed. A conventional water pump as shown in FIG. 8 includes a housing 1 in which a pumping portion 11 and a bearing portion 14 are provided, a shaft 3 which is rotatably supported by a bearing 2 of the bearing portion 14, and an impeller 20 which is fixed to one end of the shaft 3 to be rotated together therewith within the pumping portion 11. A mechanical seal 5 is used for preventing the invasion of a cooling water into the bearing 14 which is to be circulated compulsory by the impeller 20.

It is well recognized that during circulation of the cooling water by the impeller 20 bubbles remained behind the impeller 20 should be transferred to a frontward side thereof. In light of this, a pair of symmetrical annular holes 23 formed in the impeller 20 with respect to a hole central 22 so as to enable the foregoing transfer of the bubbles. In addition, at a concave backside portion of the impeller 20, there are formed a pair of projections or wings 25, which are positioned in a point symmetry with the hole 23, in order to establish a connection between an outer Periphery 26 of the backside portion of the impeller 20 and an annular outer periphery 24 of the hole 23. Each wing 25 is located at a position which is in the neighbourhood of a rearward side in the rotation direction of the impeller, and is configurated in such a manner that it is not in the form of a straight line but is formed into a curvature so as to draw a swirl toward the center Of the impeller 20.

The cooling water containing the bubbles is gathered or introduced in each of the holes 23 by the wings 25, and is exhausted toward the frontward side of the impeller 20.

However, the foregoing conventional water pump has the following drawbacks. That is to say, the bubbles remained behind the impeller lower a cooling ability of a sliding portion of the mechanical seal, which brings about a temperature rise at the sliding portion of the mechanical seal. Thus, this results in the deterioration of the sealing ability of the mechanical seal. For the prevention of such problem, each hole 23 is set to be perpendicular to the rotational direction of the impeller, which brings the insufficient transfer of the bubbles toward the frontward side of the impeller upon vigorous cavitation. Furthermore, the formation of the concave backside portion of the impeller 20 requests a thinner thickness thereof, resulting in that it is difficult to ensure a sufficient strength or stiffness of the impeller 20 per se.

In addition, an irregular flow of the cooling water behind the impeller 20 due to each wing 25 acts as a considerable resistance against the impeller 20, which results in a load to a mechanism for driving the impeller 20. Thus, in the long run, the efficiency of the water pump per se is lowered.

SUMMARY OF THE INVENTION

It is, therefore, a primary object of the present invention to provide an improved water pump without the foregoing drawbacks.

It is another object of the present invention to provide a water pump a sufficient strength thereof and an effective transfer of bubbles from a rearward side to a frontward side thereof.

In order to attain the foregoing objects, a water pump is comprised of a housing having therein a pumping portion and a bearing portion, a shaft rotatably supported by the bearing portion, an impeller fixedly mounted on one end of the shaft and having a frontward side and a rearward side, a plurality of equally pitched vanes in the circumferential direction, and a hole means penetrating the impeller and making an angle relative to the rotation direction thereof a front end of the hole means being downstream of a rear end thereof, in the direction of rotation.

BRIEF DESCRIPTION OF THE DRAWINGS

The above and other objects, features and advantages of the present invention will be more apparent and more readily appreciated from the following detailed description of preferred exemplarily embodiments of the present invention, taken in connection with the accompanying drawings, in which.

DESCRIPTION OF THE PREFERRED EMBODIMENTS

Figure 1:
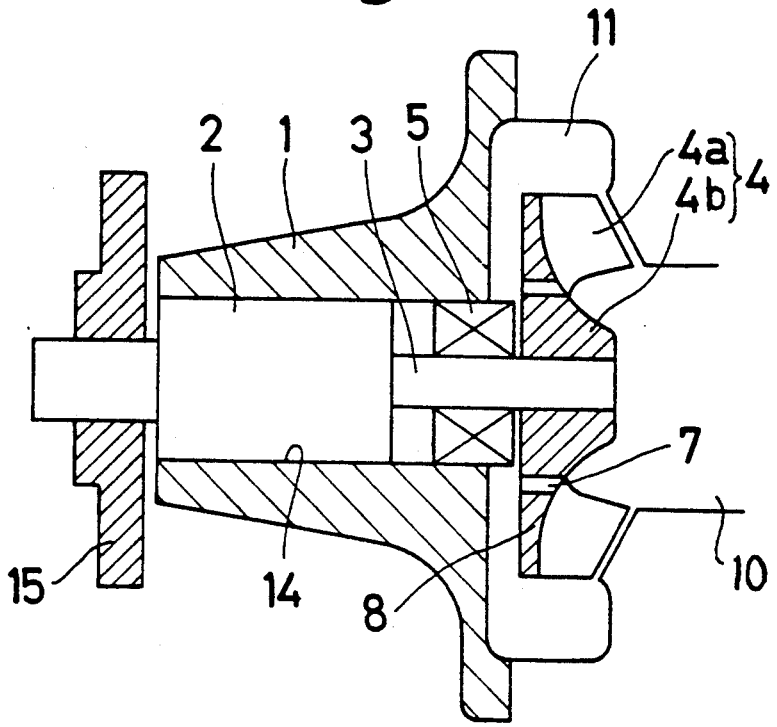
FIG. 1 is a cross-sectional view of a water pump according to an embodiment of the present invention.

Referring to FIG. 1, there is illustrated a water pump including a housing 1 within which a pumping portion 11 and a bearing portion 14 are provided. The bearing portion 14 receives fixedly therein a bearing 2 which is set to support a shaft 3 rotatably.

One end or a left end of the shaft 3 is set to be supported by the bearing 2 so as to be extended or projected outwardly from the housing 1 and the other end or a right end of the shaft 3 is set to be located in the pumping portion 11.

In addition, the left end of the shaft 3 is fixedly mounted with a pulley 15 through which a driving force from an engine (not shown) is set to be transmitted to the shaft 3. An impeller 4 is coupled to the right end of the shaft 3 for the compulsive circulation of an amount of cooling water. An inlet 10 for introducing the cooling water into the water pump is provided at a right side of the impeller 4.

In order to interrupt a fluid communication between the pumping portion 11 and the bearing portion 14, a mechanical seal 5 is provided behind or at a rearward portion of a boss portion **4*b* of the impeller 4. The mechanical seal 5 acts as a barrier against the invasion of the cooling water into the bearing portion 14 from the pumping portion 11**.

Figure 2:
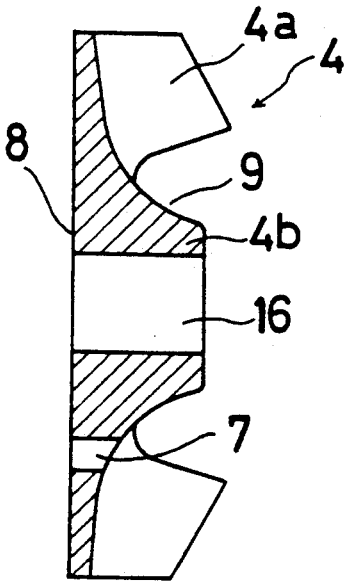
FIG. 2 is a cross-sectional view of an impeller of a water pump.
Figure 3:
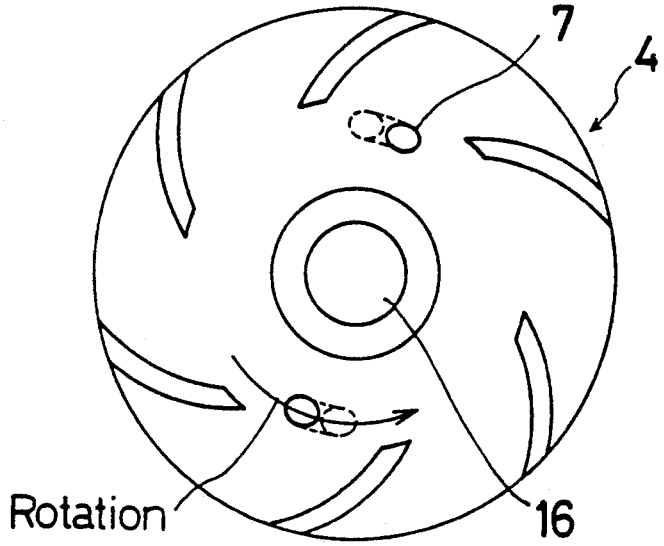
FIG. 3 is a front view of an impeller of a water pump.
Figure 4:
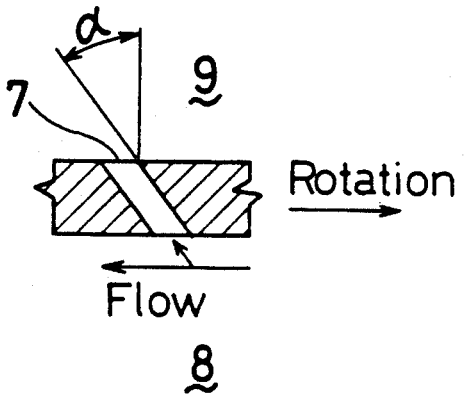
FIGS. 4, 5 and 6 each of which shows an example of the basic concept of the present invention.

As shown in FIGS. 2 through 4, the impeller 4 has a plurality of equally pitched vanes 4*a* and the boss portion 4*b*. A pair of symmetrical annular holes 7 with respect to the boss portion 4*b* are formed in the impeller 4, each of which is to be located between the vane 4*a* and the boss 4*b* and is inclined in the direction of rotation so as to make an angle of a with respect to a line normal to the rotation direction of the impeller 4. It should be noted that one, three or more holes can be provided, on that the pair of holes 7 can be positioned unsymmetrically.

The holes 7 in the impeller 4 serves for a transfer or exhaustion of bubbles therebehind from a rearward side 8 toward a frontward side 9 of the impeller 4.

Figure 5:
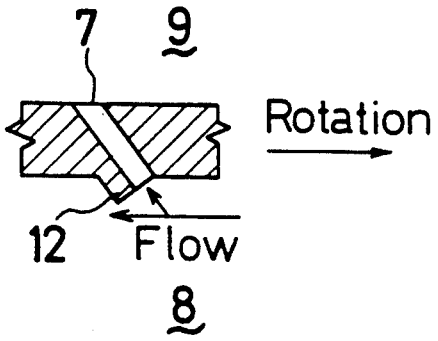
Figure 6:
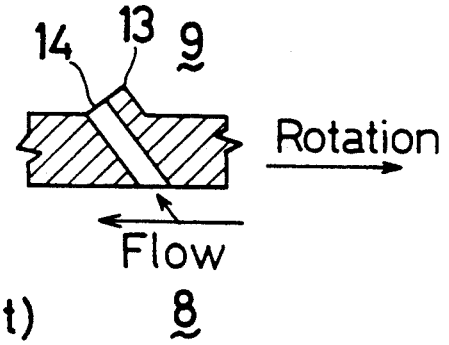
Figure 8:
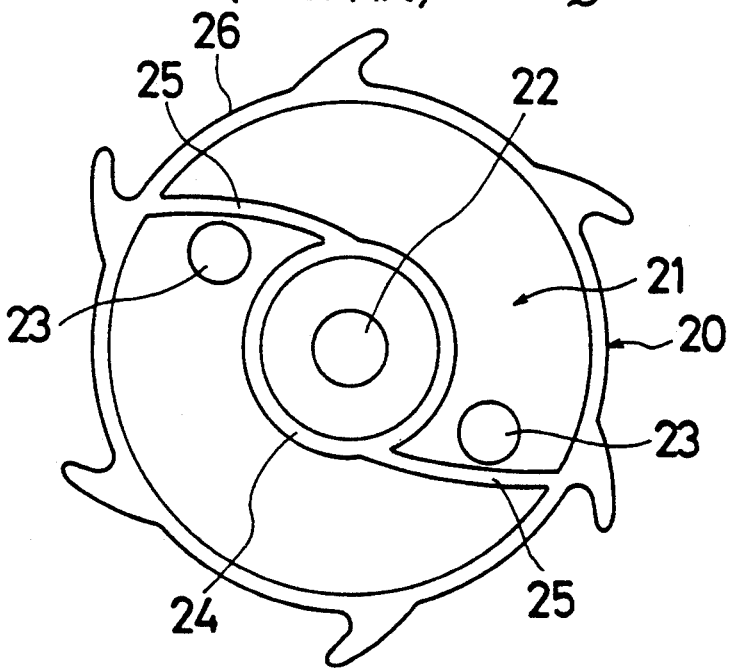
Fig. 8 (Prior Art)
FIG. 8 is a cross-sectional view of an impeller of a conventional water pump.
Figure 7:
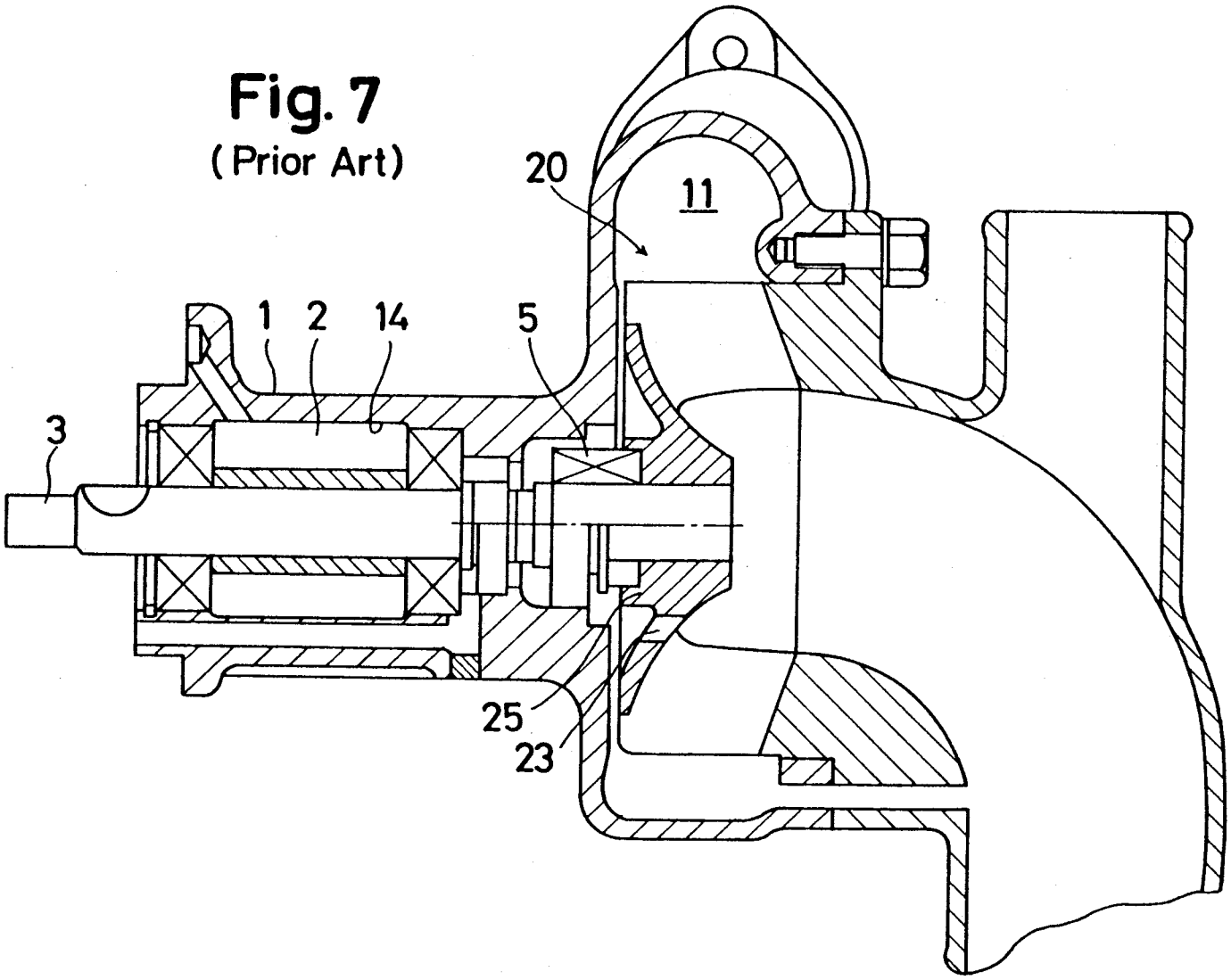
Fig. 7 (Prior Art)
FIG. 7 shows a cross-sectional view of a conventional water pump.

For assuring the easy transfer or exhaustion of the bubbles, an additional mechanism is employed. That is to say, as shown in FIG. 5, a guide 12 is formed integrally with the impeller 4 so as to be located at the rearward side 8 and is set to be projected downstream of the holes the rotation direction of the impeller 4 for enabling the easy introduction of bubbles and the cooling water. Contrary to this, as shown in FIG. 6, another guide 13 can be provided at the frontward side 9 of the impeller 4 in such a manner that the guide 13 is projected upstream of the holes in the rotation direction of the impeller 4 so as to reduce the resistance against the cooling water upon exhaustion of the cooling water and bubbles. It is to be noted that the guide 12 / 13 enables an easy forming of the holes 7 in the impeller 4.

In the foregoing construction, the cooling water supplied from the inlet 10 is set to be increased in pressure before its supply to the pumping portion 11. However, during engine rotation at a high speed, the amount of the cooling water is increased, which brings about a pressure drop of the cooling water in the inlet 10, thereby developing or generating vapor bubbles in the inlet 10 when the pressure of the cooling water becomes equal to or less than the saturated steam pressure.

The bubbles are set to be transferred, concurrent with the cooling water, from the impeller 4 to the pumping portion 11. At this time, though most bubbles due to cavitation disappear, the remaining bubbles are at the rearward side 8 of the impeller 4. The resultant bubbles can be released or transferred to the frontward side 9 of the impeller 4 through the holes 7.

According to the present invention, the holes each of which is formed in the impeller and inclined to the rotation direction, enables the smooth exhaustion of the bubbles remained behind the impeller toward its frontward side, and the cooling ability of the mechanical seal can be assured.

In addition, the foregoing concept enables the flat configuration of the rearward side of the impeller, resulting in the prevention of the irregular flow of the cooling without affecting the foregoing exhaustion.

In comparison with the conventional water pump, in the water pump according to the present invention, only the formation of one or more holes in the impeller is required thereby assuring the sufficient strength of the impeller. This can be applied to any water pump having an impeller which is different from the foregoing one.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. A centrifugal water pump comprising:
   - a housing having therein an inlet, a pumping portion and a bearing portion;
   - a shaft rotatably supported by the bearing portion;
   - an impeller fixedly mounted on one end of the shaft and having a frontward side facing toward said inlet and a rearward side;
   - a plurality of equally pitched vanes in the circumferential direction; and
   - hole means penetrating the impeller, said hole means making an angle relative to the rotation direction thereof such that an end of each of said hole means at the frontward side thereof is downstream of an end of said each of said hole means at a rearward side thereof, in the rotation direction.

2. A water pump in accordance with claim 1, wherein the hole means include a pair of holes, each of which is spaced from the shaft.

3. A water pump in accordance with claim 2, wherein the holes are arranged symmetrically with respect to the shaft.

4. A water pump in accordance with claim 1, wherein the hole means include a pair of holes spaced from the shaft, and a pair of guides corresponding thereto, each of which is provided as the frontward side of the impeller so as to be projected therefrom upstream of the holes in the rotation direction of the impeller.

5. A water pump in accordance with claim 1, wherein the hole means include a pair of holes spaced from the shaft, and a pair of guides corresponding thereto, each of which is provided at the rearward side of the impeller so as to be projected therefrom downstream of the holes in the rotation direction of the impeller.

* * * * *